US011363879B2

(12) United States Patent
Maxwell

(10) Patent No.: US 11,363,879 B2
(45) Date of Patent: Jun. 21, 2022

(54) WASHING MACHINE SEAL CLEANING TOOL

(71) Applicant: Kinley Nicole Maxwell, Casper, WY (US)

(72) Inventor: Kinley Nicole Maxwell, Casper, WY (US)

( * ) Notice: Subject to any disclaimer, the term of this patent is extended or adjusted under 35 U.S.C. 154(b) by 185 days.

(21) Appl. No.: 16/563,179

(22) Filed: Sep. 6, 2019

(65) Prior Publication Data

US 2020/0077777 A1 Mar. 12, 2020

Related U.S. Application Data

(60) Provisional application No. 62/728,914, filed on Sep. 10, 2018.

(51) Int. Cl.

| | |
|---|---|
| ***A46B 5/00*** | (2006.01) |
| ***D06F 39/14*** | (2006.01) |
| ***A46B 9/02*** | (2006.01) |

(52) U.S. Cl.

CPC ..... *A46B 5/0012* (2013.01); *A46B 9/028* (2013.01); *D06F 39/14* (2013.01); *A46B 2200/3073* (2013.01)

(58) Field of Classification Search

CPC ..... A47L 11/33; A47L 11/38; A47L 11/00; A47L 11/04; A47L 11/08; A47L 11/14; A47L 11/22; A47L 11/26; A47L 11/32; A46B 5/0012; A46B 9/028

See application file for complete search history.

(56) References Cited

U.S. PATENT DOCUMENTS

| | | | | |
|---|---|---|---|---|
| 866,640 | A * | 9/1907 | Friedman | A47L 11/33 15/42 |
| 3,583,818 | A * | 6/1971 | Smyth | A47L 11/408 401/22 |
| 2006/0016031 | A1* | 1/2006 | Llanes | A47L 13/14 15/119.1 |
| 2010/0050355 | A1* | 3/2010 | Repp | A46B 9/00 15/160 |
| 2017/0208931 | A1* | 7/2017 | Pereira | A46B 9/005 |

* cited by examiner

*Primary Examiner* — Shay Karls

(74) *Attorney, Agent, or Firm* — Gutwein Law; Greg Geiser

(57) ABSTRACT

A washing machine seal cleaning tool specifically configured for use in cleaning the seal or gasket of a washing machine. The tool includes a handle portion having a length between a first end and a second end. The first end is bifurcated defining a space for the coupling of the rotating brush member between the bifurcations. The rotating brush member having a plurality of cleaning members configured to clean the seal. The first end including at least one brush member extending perpendicular to the handle length and having a conical shape.

18 Claims, 5 Drawing Sheets

WASHING MACHINE SEAL CLEANING TOOL

CROSS-REFERENCE TO RELATED APPLICATION

This U.S. patent application claims priority to U.S. Provisional application: Application No. 62/728,914 filed Sep. 10, 2018, the disclosure of which is considered part of the disclosure of this application and is hereby incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

This invention relates generally to cleaning tool specifically configured for use in cleaning the seal or gasket of a washing machine. In one aspect, the tool is configured with a roller assembly for placement into an interior channel of a washing machine watertight sealing member.

BACKGROUND

A standard washing machine includes a large gasket member generally encircling the opening and configured to form a watertight seal between the opening and the washing machine door. In a typical front-loading washing machine this gasket member generally includes a large flange having a groove and collection area encircling the opening and extending the entire circumference of the gasket. Overtime, this flange, groove, and collection area becomes dirty, smelly, and prone to the growth of molds and bacteria within these areas.

Generally, to clean these areas, a user must manually clean and scrub these areas with a sponge or cleaning rag. Alternately, there are some products within the marketplace that generally attempt to clean this gasket and sealing areas with a solution, wherein the wash machine is operated without clothing in an attempt to allow the solution to clean the gasket and associated areas.

Although these methods can be utilized, they often are not effective and can be difficult to undertake. In particular, the gasket, associated flanges, and grooves are difficult to reach and clean and include sharp angles and crevices that cannot be reached and contacted with traditional cleaning methods.

Therefore, there appears a need within the marketplace for a dedicated device in the form of a cleaning tool specifically configured for the cleaning of a washing machine seal, gasket, flange, and associated grooves and crevices.

SUMMARY OF THE INVENTION

The device of the present disclosure is most generally related to a tool configured to aid a user in cleaning the sealing member or gasket portion of a washing machine. The device is adapted for the specific purpose of cleaning the sealing member in communication with a door of a washing machine. The device is configured with a handle portion sized and shaped to be grasped by a user for manipulation of the tool at a second end and coupled to a tool end in the form of a rotating brush member at a first end of the handle portion. The rotating brush member is movable on the first end of the handle portion though a coupling within a bifurcation of the first end.

The tool end in the form of the rotating brush member is configured to rotate about an axis in line with the coupling between the bifurcations of the handle end and includes a plurality of cleaning members positioned about an exterior surface. The rotating brush member comprised of a cylindrical roller having a circumference with the plurality of cleaning members positioned about the circumference in an alternating position. Accordingly, the plurality of cleaning members are comprised of a pair of distinct cleaning implements in the form of bristles and pads. The pads generally comprised of a sponge-like material having an absorbency and porosity configured to collect moisture.

The tool end further including a pair of brush members. Each brush member of the pair of brush members extending outward perpendicular to a length of the handle portion along the axis of rotation of the rotating brush member. Each brush of the pair of brush members having a conical shape, wherein a portion of each brush member adjacent to the handle portion has a first diameter and a portion of each brush member opposed the first diameter has a second diameter, wherein the second diameter is greater than the diameter of the first diameter. The conical shape of each brush member configured to compress into small areas and crevices of the gasket.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
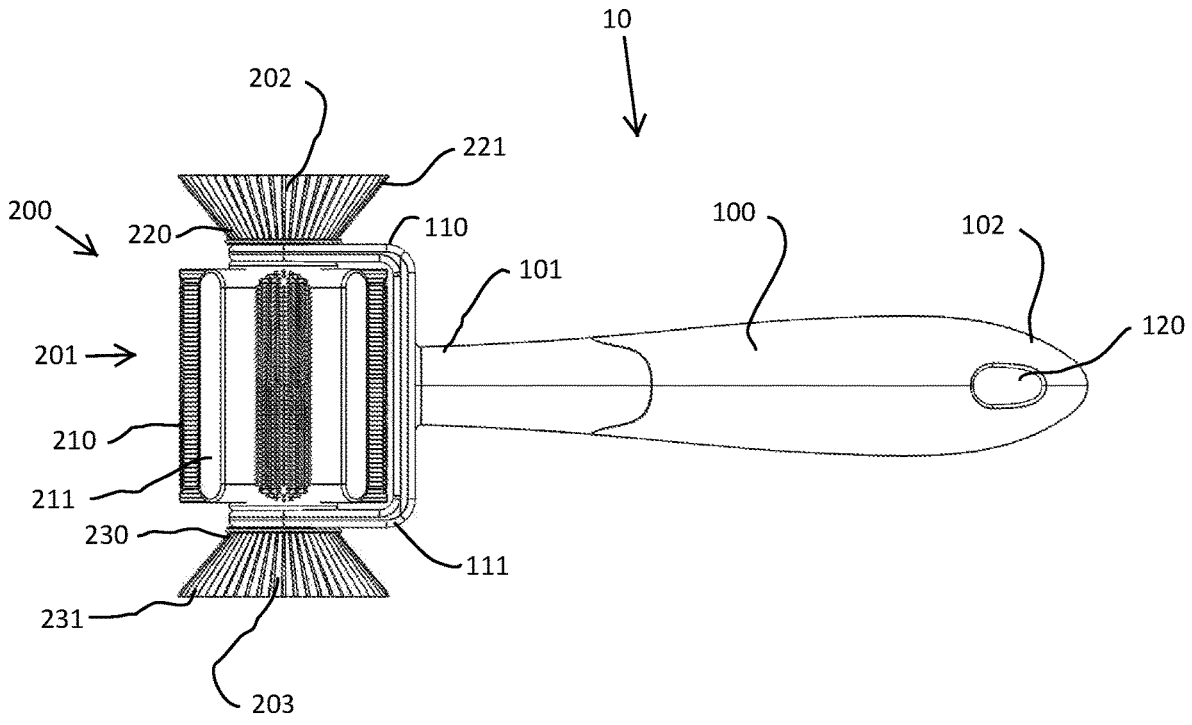
FIG. 1 shows the top of the device, according to the present disclosure.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the terms "front," "back," "rear," "upper," "lower," "right," and "left" in this description are merely used to identify the various elements as they are oriented in the FIGS., with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature. Similarly, coupled can refer to a two member or elements being in communicatively coupled, wherein the two elements may be electronically, through various means, such as a metallic wire, wireless network, optical fiber, or other medium and methods.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Figure 2:
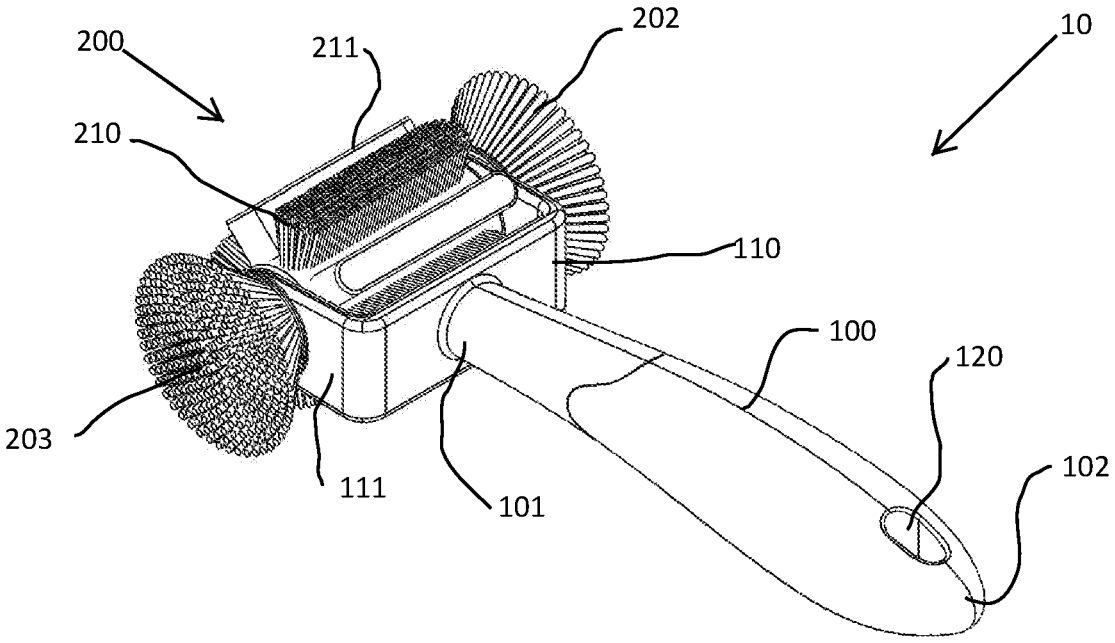
FIG. 2 shows a perspective view of the device, according to the present disclosure.
Figure 3:
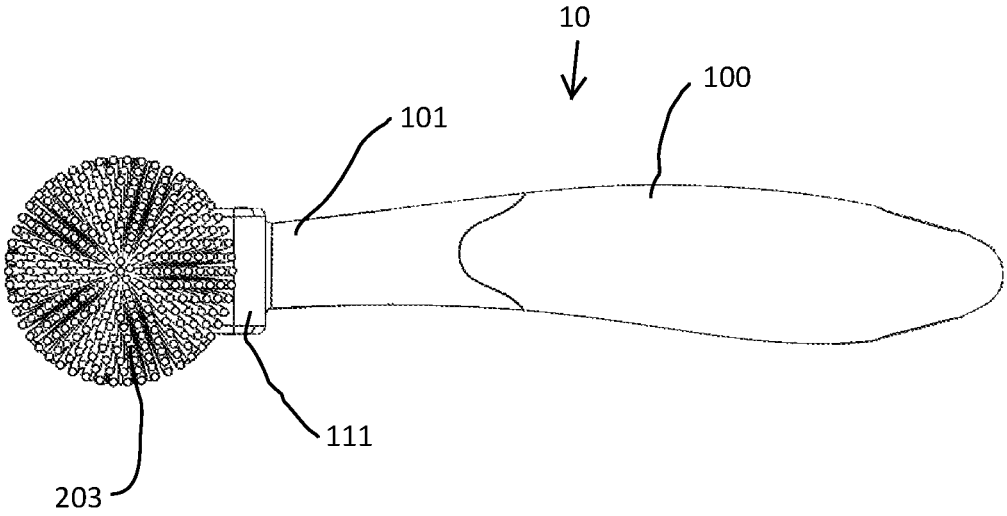
FIG. 3 shows a side view of the device, according to the present disclosure.
Figure 4:
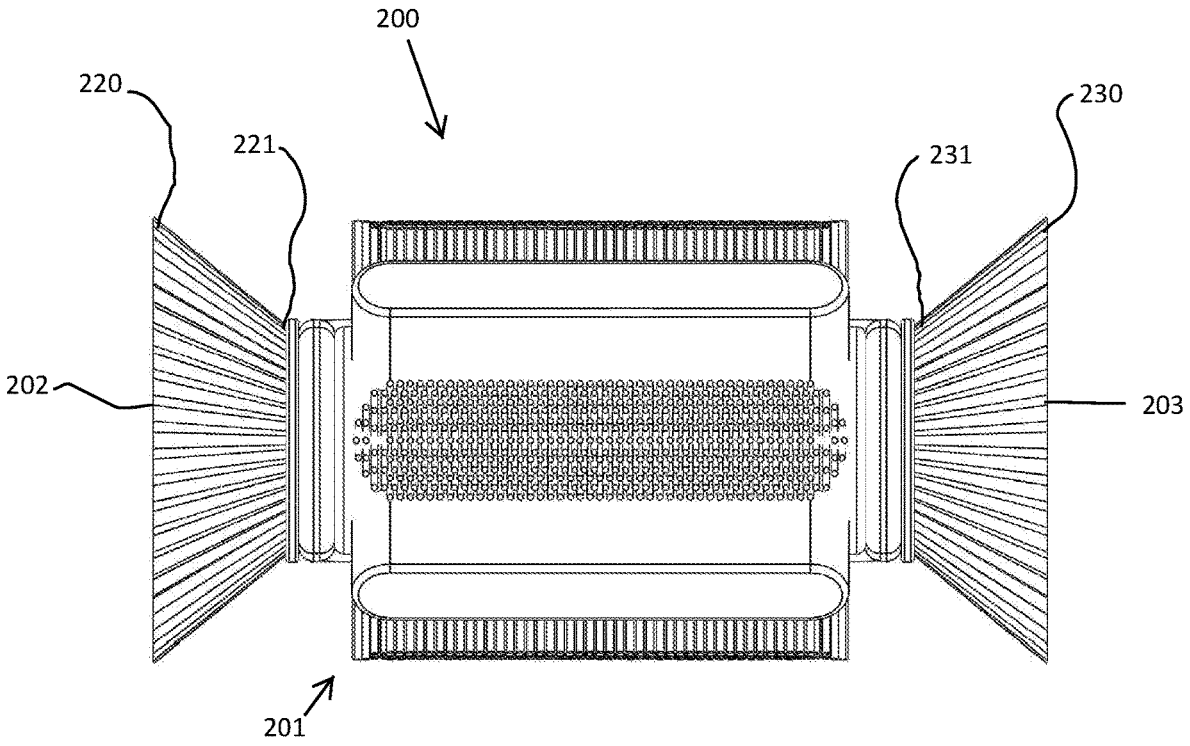
FIG. 4 shows a front side view of the device, according to the present disclosure.
Figure 5:
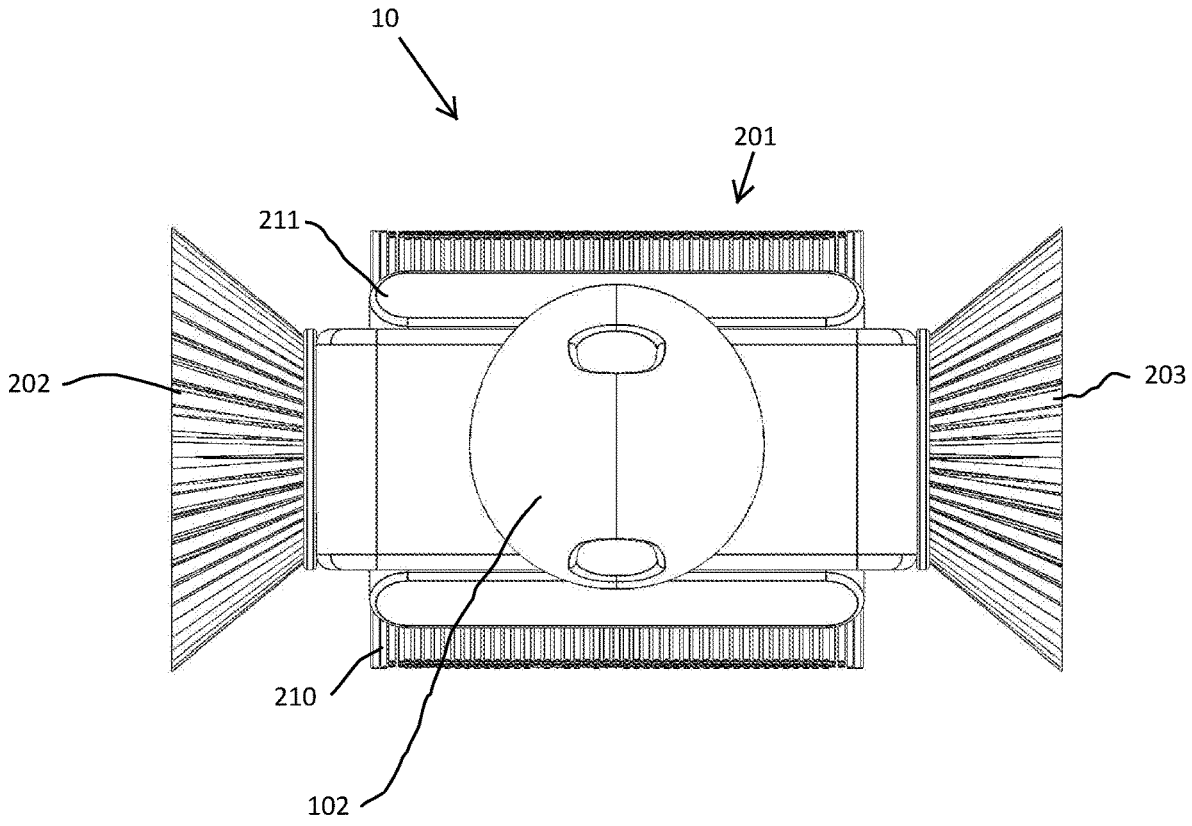
FIG. 5 shows a rear side view of the device, according to the present disclosure.

Referring to the figures, FIG. 1 to FIG. 5 show the washing machine seal cleaning tool according to the present invention and generally referred to as device 10. The device 10 is most generally configured for the specific purpose of cleaning the sealing member, gasket, flange, or boot, as it is commonly referred, in communication with a door of a washing machine. Generally, most washing machines, and more particularly, front loading washing machines, include this large sealing member around an entire circumference of the door opening of the washing machine. This sealing member is frequently constructed out of resilient material, most commonly a rubber or rubber-like material, having several ridges, grooves, or channels, to aid in a watertight fitting of the door and for trapping debris to maintain the integrity of the sealing properties of the sealing member.

The sealing member device 10 of the present disclosure is provided in an assembly of a pair of cooperative parts in the form of a handle portion 100 and a rotating brush member 200 coupled to the handle portion 100. The handle portion 100 having a first end 101 and a second end 102 extending opposite the first end 101 and defining a length of the handle portion 100. The first end 101 is bifurcated culminating in a first first end 110 and second first end 111 with the first first end 110 and the second first end 111 opposed to define a space for the coupled receipt of the rotating brush member 200 between the first first end 110 and the second first end 111.

The handle portion 100 second end 102 having a shape configured for easy grasping by a user within a hand for manipulation of the device 10 during use. The second end 102 may include a material to increase friction and comfort during use, including, but not limited to, a rubber, a silicone, or a rubber-like material. The second end 102 preferably having an aperture 120. The aperture 120 generally selected to have a size to allow for easy hanging and alternately sized to receive a cord or lanyard for easy hanging when the device 10 is not in use.

In an alternate embodiment of the present disclosure, the handle portion 100 may generally be provided with a structure that is generally hollow and forming a cavity (not pictured) for the placement of a cleaning solution that may be expressed during use. Accordingly, the cavity of the handle portion 100 will have a cooperating structure, such as, but not limited to, a pair of apertures in communication with the cavity for filling with a cleaning solution and allowing the cleaning solution to exit the cavity during cleaning. In this configuration, the aperture for expressing the cleaning solution will be adjacent to the rotating brush member 200.

The rotating brush member 200 cylindrical in shape with a circumference and generally forming a roller, wherein the coupling between the first first end 110 and the second first end 111 of the brush member 200 is configured to rotate about an axis in line with the coupling, wherein the axis of rotation of the rotating brush member 200 is perpendicular to the length of the handle portion 100.

The rotating brush member 200 including a plurality of cleaning members 201 positioned about the circumference. The plurality of cleaning members 201 having a surface configured for cleaning and scrubbing of the sealing member, wherein the plurality of cleaning members 201 contact the surfaces of the sealing member during use. In the preferred embodiment of the present disclosure, the plurality of cleaning members 201 are comprised of a pair of distinct cleaning implements in the form of bristles 210 and pads 211 in an alternate placement around the circumference. The pads 211 generally comprised of a sponge or sponge-like material having an absorbency and porosity configured to collect moisture during use of the device 10 for cleaning.

The first end 101 further including a pair of brush members 202, 203. Each brush member 202, 203 of the pair of brush members 202, 203 extending outward perpendicular to the length of the handle portion 100 along the axis of rotation of the rotating brush member 200, wherein a first brush member 202 extends from the first first end 110 and a second brush member 203 extends from the second first end 111. Each brush 202, 203 of the pair of brush members 202, 203 has a conical shape. Accordingly, the first brush member 202 having a first diameter 220 adjacent to the first first end 110 and a second diameter 221 opposed the first diameter 220 extending outward perpendicular to the length of the handle portion 100, wherein the second diameter 221 is greater than the first diameter 220 to form the conical shape of the first brush member 202.

Correspondingly, the second brush member 203 has a first diameter 230 adjacent to the second first end 111 and a second diameter 231 opposed the first diameter 230 extending outward perpendicular to the length of the handle portion 100, wherein the second diameter 231 is greater than the first diameter 230 to form the conical shape of the second brush member 203. The conical shape of each brush member 202, 203 of the pair of brush members 202, 203 configured to compress into small areas and crevices of the sealing member for cleaning. The first and second brush members 202, 203 generally comprised of a plurality of bundled bristles in an angled assembly to form the first diameters 220, 230 and second diameters 221, 231.

Although it is preferred that the device 10 first end 101 includes a pair of brush members 202, 203, the device 10 can be easily modified to only include a single conical brush member. Accordingly, under this configuration, the device 10 first end 101 would include at least one brush member, wherein one brush member 202, 203 of the pair of brush members 202, 203 is eliminated.

In an alternate assembly of the device 10 of the present disclosure, the handle portion 100 and rotating brush member 200 may be provided in an assembly wherein the brush member 200 is removably received on the handle 100 first 101. Accordingly, the brush member 200 may be provided in a replaceable assembly, wherein the brush member 200 can be removed and replaced if it becomes too worn. In a further alternate assembly, the device 10 may be constructed of materials to allow for disposal of the device 10 after use. Accordingly, the device 10 will maintain the handle 100 and brush member 200 components but utilize materials that are less robust and durable.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A washing machine seal cleaning tool configured to clean the sealing member of a washing machine door, the washing machine seal cleaning tool comprising:

a handle, the handle having a first end and a second end defining a length;

a brush, the brush being cylindrical and coupled to the first end, wherein the brush coupling is capable of rotation;

a plurality of cleaning members positioned about the brush; and at least one brush member coupled to the first end, the at least one brush member being conical in shape and extending outward and perpendicular to the length of the handle, the at least one brush member conical shape having a first diameter adjacent to the brush and a second diameter opposed the first diameter with the first diameter less than the second diameter, wherein the brush member conical shape generally extends outward from the brush in an angled assembly from the lesser first diameter to the greater second diameter.

2. The washing machine seal cleaning tool as in claim 1, wherein the plurality of cleaning members is comprised of bristles.

3. The washing machine seal cleaning tool as in claim 1, wherein the plurality of cleaning members is comprised of pads.

4. The washing machine seal cleaning tool as in claim 1, wherein the plurality of cleaning members is comprised of both bristles and pads.

5. The washing machine seal cleaning tool as in claim 1 wherein the tool includes two brush members.

6. A washing machine seal cleaning tool configured to clean the sealing member of a washing machine door and a washing machine door, the washing machine seal cleaning tool comprising:

a handle, the handle comprising:

a first end, the first end bifurcated and having a first first end and a second first end spaced apart from the first first end to define the bifurcation; and a second end opposite the first end, a distance between the first end and the second defining a length of the handle;

a brush, the brush being cylindrical with a circumference and rotationally coupled to the first first end and the second first end with the coupling defining an axis of rotation of the brush;

a plurality of cleaning members positioned about the circumference of the brush; and at least one brush member coupled to the first end, the at least one brush member being conical in shape and extending outward from the first end perpendicular to the length of the handle, the at least one brush member conical shape having a first diameter adjacent to the first end and a second diameter opposed the first diameter with the first diameter less than the second diameter, wherein the brush member conical shape generally extends outward from the brush in an angled assembly from the lesser first diameter to the greater second diameter.

7. The washing machine seal cleaning tool as in claim 6, wherein the plurality of cleaning members is comprised of bristles.

8. The washing machine seal cleaning tool as in claim 6, wherein the plurality of cleaning members is comprised of pads.

9. The washing machine seal cleaning tool as in claim 6, wherein the plurality of cleaning members is comprised of both bristles and pads.

10. The washing machine seal cleaning tool as in claim 9, wherein the plurality of cleaning members is arranged in an alternate pattern along the axis of rotation with both bristles and pads.

11. The washing machine seal cleaning tool as in claim 10, wherein the pads are a sponge.

12. The washing machine seal cleaning tool as in claim 10, wherein the tool includes two brush members.

13. A washing machine seal cleaning tool configured to clean the gasket of a washing machine door between the washing machine door and the washing machine, the washing machine seal cleaning tool comprising:

a handle, the handle comprising:

a first end, the first end bifurcated and having a first first end and a second first end spaced apart from the first first end to define the bifurcation; and a second end opposite the first end, a distance between the first end and the second end defining a length of the handle, the second end having an aperture;

a brush, the brush being cylindrical with a circumference and rotationally coupled to the first first end and the second first end with the coupling defining an axis of rotation of the brush;

a plurality of cleaning members positioned about the circumference of the brush;

a first brush member coupled to the first first end, the first brush member being conical in shape and having a first diameter and a second diameter, wherein the second diameter is greater than the first diameter extending outward perpendicular to the length of the handle opposite the brush, wherein the first brush member conical shape generally extends from the brush in an angled assembly from the lesser first diameter to the greater second diameter; and a second brush member coupled to the second first end, the second brush member being conical in shape and having a first diameter and a second diameter, wherein the second diameter is greater than the first diameter extending outward perpendicular to the length of the handle opposite the brush, wherein the second brush member conical shape generally extends from the brush in an angled assembly from the lesser first diameter to the greater second diameter.

14. The washing machine seal cleaning tool as in claim 13, wherein the plurality of cleaning members is comprised of bristles.

15. The washing machine seal cleaning tool as in claim 13, wherein the plurality of cleaning members is comprised of pads.

16. The washing machine seal cleaning tool as in claim 13, wherein the plurality of cleaning members is comprised of both bristles and pads.

17. The washing machine seal cleaning tool as in claim 16, wherein the plurality of cleaning members is arranged in an alternate pattern along the axis of rotation with both bristles and pads.

18. The washing machine seal cleaning tool as in claim 13, wherein the pads are a sponge.

* * * * *